US007052115B2

(12) United States Patent
Sekiya

(10) Patent No.: US 7,052,115 B2
(45) Date of Patent: May 30, 2006

(54) INK JET RECORDING APPARATUS

(75) Inventor: Yasuhito Sekiya, Chiba (JP)

(73) Assignee: SII Printek Inc., Chiba (JP)

( * ) Notice: Subject to any disclaimer, the term of this patent is extended or adjusted under 35 U.S.C. 154(b) by 239 days.

(21) Appl. No.: 10/612,559

(22) Filed: Jul. 2, 2003

(65) Prior Publication Data

US 2004/0051751 A1 Mar. 18, 2004

(30) Foreign Application Priority Data

Aug. 27, 2002 (JP) ..... 2002-247378

(51) Int. Cl.
*B41J 2/05* (2006.01)

(52) U.S. Cl. ..... 347/57; 347/68; 347/69

(58) Field of Classification Search ..... 347/54, 347/58, 57, 68–72, 14
See application file for complete search history.

(56) References Cited

U.S. PATENT DOCUMENTS 6,050,665 A * 4/2000 Kishi ..... 347/14
6,431,672 B1 * 8/2002 Ardito et al. ..... 347/7

* cited by examiner

*Primary Examiner*—Lamson Nguyen
(74) *Attorney, Agent, or Firm*—Adams & Wilks

(57) ABSTRACT

An ink jet recording apparatus has an ink jet head comprised of a substrate having at least a pair of partition walls with deformable side walls spaced apart at a preselected distance to form a channel for receiving ink and communicating with a nozzle opening, a pair of electrodes each connected to respective ones of the side walls of the partition walls, and a driving circuit for applying a driving voltage to the pair of electrodes to deform the side walls of the partition walls to vary the volume of the channel to thereby eject ink from the channel. A data storage device of the ink jet head stores two or more different types of driving information data of the ink jet head including driving condition data. An external circuit is connected to the driving circuit of the ink jet head and has a setting device for reading at least the driving condition data stored in the data storage device and automatically setting driving conditions of the ink jet head.

20 Claims, 11 Drawing Sheets

INK JET RECORDING APPARATUS

BACKGROUND OF THE INVENTION

1. Field of the Invention

The present invention relates to an ink jet recording apparatus which is applied to, for example, a printer or a facsimile machine and which discharges ink from a nozzle opening.

2. Description of the Related Art

Up to now, an ink jet recording apparatus has been known in which an ink jet head for discharging ink from plural nozzles is used to record characters and images on a recording medium. In such an ink jet recording apparatus, the ink jet head opposite to the recording medium is fixed to a head holder, the head holder is mounted to a carriage, and scanning is performed in a direction perpendicular to a conveying direction of the recording medium.

FIG. 9 is a schematic exploded view of an example of an ink jet head used in such an ink jet recording apparatus, and FIGS. 10A and 10B are sectional views of a main part of the ink jet head. As shown in FIG. 9 and FIGS. 10A and 10B, in a piezoelectric ceramic plate 201, plural grooves 202 are arranged in parallel with each other and are separated from one another by side walls 203. One end portion of each groove 202 in a longitudinal direction thereof is provided so as to extend to one end surface of the piezoelectric ceramic plate 201 while the other end portion is not extended to the other end surface and gradually becomes shallow. Further, electrodes 205 for application of a driving electric field are formed on surfaces on the opening side of both side walls 203 of each groove 202 in the longitudinal direction.

A cover plate 207 is jointed to the opening side of the grooves 202 of the piezoelectric ceramic plate 201 through an adhesive 209. The cover plate 207 is provided with: an ink chamber 211 that is a concave portion communicated with the shallow other end portion of each groove 202; and an ink supply port 212 that penetrates a bottom portion of the ink chamber 211 in an opposite direction to the grooves 202.

Further, a nozzle plate 215 is jointed to an end surface, which is opened with the grooves 202, of a joint member of the piezoelectric ceramic plate 201 and the cover plate 207. Nozzle openings 217 are formed at positions, which are opposite to the respective grooves 202, in the nozzle plate 215.

Note that a wiring substrate 220 mounted with, for example, a driving circuit having a driving IC and the like, is fixed onto a surface, which is on the opposite side to the cover plate 207, of the piezoelectric ceramic plate 201 on the opposite side to the nozzle plate 215. In the wiring substrate 220, wirings 222 connected to the respective electrodes 205 through bonding wires 212 or the like are formed, and a driving voltage can be applied to the electrodes 205 through the wirings 222.

In the ink jet head structured as described above, when ink is filled into the respective grooves 202 from the ink supply port 212, and a predetermined driving electric field is made to act on both the side walls 203 of the predetermined groove 202 through the electrodes 205, the side walls 203 are deformed to vary a volume in the predetermined groove 202, as a result of which an ink droplet in the groove 202 is discharged from the nozzle opening 217.

For example, as shown in FIG. 11, in the case where ink is discharged from the nozzle opening 217 corresponding to a groove 202*a*, a positive driving voltage is applied to electrodes 205*a* and 205*b* in the groove 202*a*, and also, electrodes 205*c* and 205*d* respectively opposite thereto are made to be grounded. Thus, a driving electric field in a direction toward the groove 202*a* acts on side walls 203*a* and 203*b*. When the driving electric field is perpendicular to a polarization direction of the piezoelectric ceramic plate 201, the side walls 203*a* and 203*b* are deformed in the direction of the groove 202*a* due to a piezoelectric thickness slide effect. Thus, a volume in the groove 202*a* is reduced to increase a pressure. As a result, the ink droplet is discharged from the nozzle opening 217.

In attaching the above-described ink jet head to an ink jet recording apparatus, driving conditions of the ink jet head, for example, a so-called voltage rank that indicates a magnitude of a driving voltage to be applied to electrodes in each groove, a type of ink to be used, and resolution, need to be set for each ink jet head.

For example, the voltage rank depends on a thickness of a side wall of each groove, and thus differs for each ink jet head due to a manufacturing error or the like. Further, as to identical ink jet heads as well, the voltage rank differs depending on a type of ink to be used, that is, oil-based ink, aqueous ink, or the like. For example, the case of the oil-based ink adopts a voltage of 20 to 24 V, and the voltage rises by approximately 3.0 V when the side wall becomes thick by 4.0 μm.

Therefore, according to the prior art, in, for example, the product shipment of ink jet heads, the ink jet heads are individually managed by being attached with labels each showing a voltage rank. Further, in attaching the ink jet head to an ink jet recording apparatus, setting is performed manually while an operator checks the voltage rank written in the label.

Accordingly, there is a problem in that an operation for managing and setting a voltage rank for each ink jet head becomes complicated. Further, the voltage rank needs to be set in each case of shipment or exchange of an ink jet head, which is extremely troublesome. In addition, there is a problem in that a setting error is caused by manually setting the voltage rank for each ink jet head.

Further, there is a problem in that most of ink jet-head users do not know a the lifetime of the head, and in the case where performance of the head, for example, an ink discharge characteristic is deteriorated, it is difficult for the users to make a judgment on whether the cause of the deterioration is the expired lifetime or the failure of the head. On the other hand, there is a problem in that a manufacturer does not know the head usage status on the user side and thus, it is relatively difficult for the manufacturer to discover the cause of the head failure.

It is noted that in the case where the identical ink jet head is used to the end of its lifetime without exchange, the usage status of the head can be grasped with relative ease. Thus, when a problem arises in performance of the head, a projection can be made as to which is the cause between, for example, the lifetime of the head or other factors. However, most users use plural ink jet heads while the heads are replaced with one another, and thus, it is very difficult that the usage status is managed to be grasped for each head. Further, there is also a case where, depending on the user, different types of ink are used with the identical head while being replaced with one another. Therefore, it is very difficult to discover the cause of the head failure.

SUMMARY OF THE INVENTION

The present invention has been made in view of the above, and has an object to provide an ink jet recording apparatus in which an operation for managing and setting driving conditions of an ink jet head can be simplified and a usage status of the ink jet head can be reliably grasped.

In order to attain the above described object, according to a first aspect of the present invention, there is provided an ink jet recording apparatus comprising an ink jet head which has a wiring substrate mounted with a driving circuit including a driving IC and in which a driving voltage is applied to an electrode provided on a side wall of a groove formed in a piezoelectric ceramic plate to vary a volume in the groove to thereby discharge ink filled therein from a nozzle opening; and an external circuit connected to the driving circuit. The ink jet head is provided with data storage means for storing driving information data at least including driving condition data of the ink jet head. The external circuit is provided with setting means for reading at least the driving condition data included in the driving information data and automatically setting driving conditions of the ink jet head.

According to a third aspect of the present invention, in the first or second aspect of the invention, there is provided an ink jet recording apparatus characterized in that the driving information data includes dot count data obtained by counting the number of times of ink discharge of the ink jet head.

According to a fourth aspect of the present invention, in the third aspect of the invention, there is provided an ink jet recording apparatus characterized by further including data writing means for storing the number of times of ink discharge of the ink jet head as the dot count data in the data storage means.

According to a fifth aspect of the present invention, in the fourth aspect of the invention, there is provided an ink jet recording apparatus characterized by further including: data managing means for managing the dot count data stored in the data storage means; and notifying means for notifying that the ink jet head is close to the end of its lifetime, in which the data managing means makes the notifying means operate at a time point when the dot count data attains a predetermined value or more.

According to the present invention, in the ink jet recording apparatus, the ink jet head is provided with the data storage means for storing a plurality of different types of driving information data including the driving condition data of the ink jet head, and the external circuit is provided with the setting means, which is connected to the data storage means, for reading at least the driving condition data stored in the data storage means and automatically setting the driving conditions of the ink jet head. Therefore, the operation for managing and setting the driving conditions of the ink jet head can be simplified, and the usage status of the ink jet head can be reliably grasped.

DETAILED DESCRIPTION OF THE PREFERRED EMBODIMENTS

Hereinafter, the present invention will be described in detail in accordance with embodiments thereof.

Embodiment 1

Figure 1:
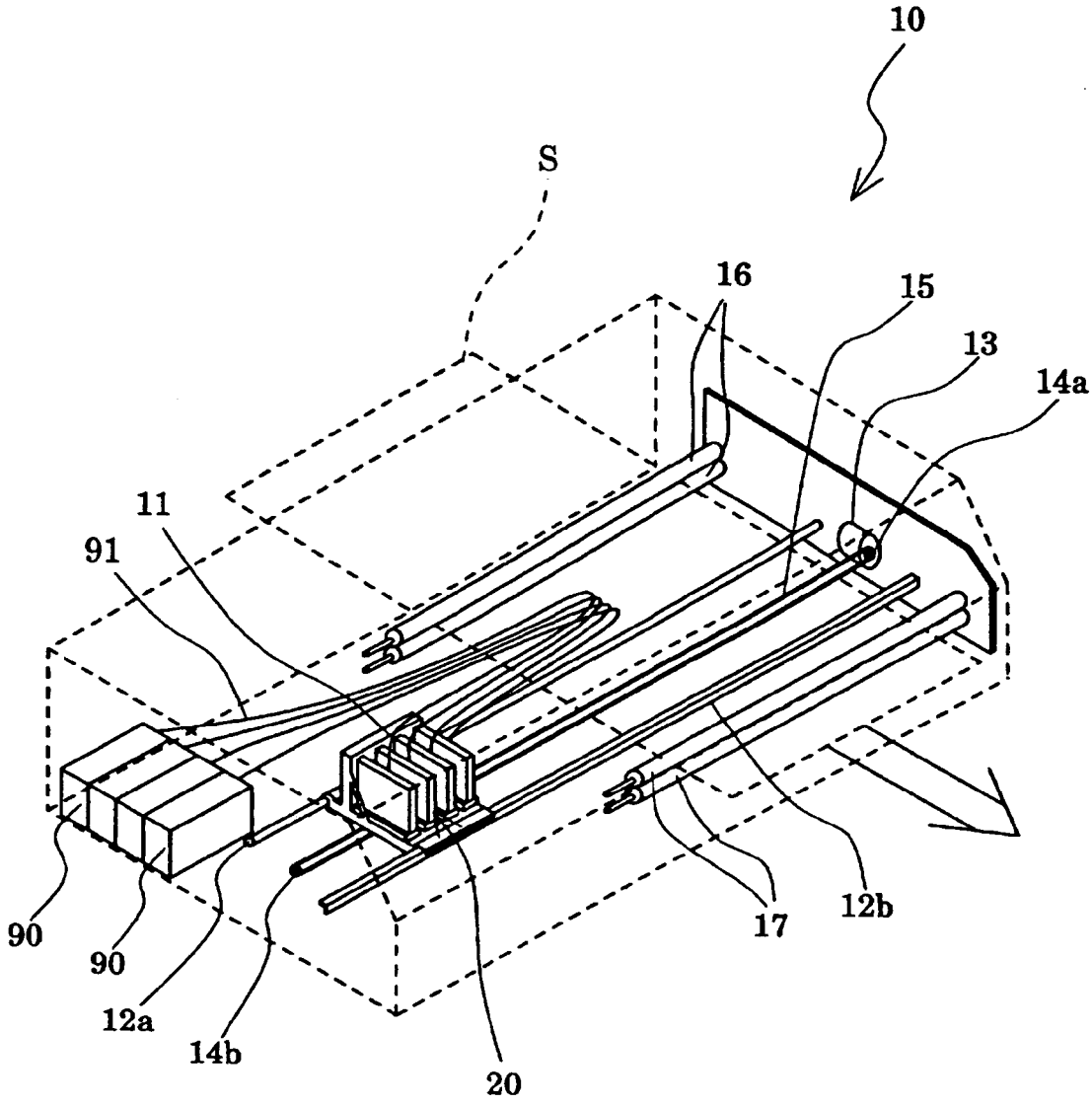
FIG. 1 is a schematic perspective view of an ink jet recording apparatus in accordance with Embodiment 1 of the present invention.

FIG. 1 is a schematic perspective view of an ink jet recording apparatus in accordance with Embodiment 1 of the present invention.

An ink jet recording apparatus 10 in this embodiment is provided with plural ink jet heads 20 for respective colors, a carriage 11 to which the ink jet heads 20 are arranged in parallel in a main scanning direction, and ink tanks 90 which constitute a part of an ink reservoir means and each of which supplies ink through an ink supply pipe 91 comprised of a flexible tube. The carriage 11 is mounted on a pair of guide rails 12*a* and 12*b* movably in an axial direction thereof. Further, a driving motor 13 is provided on the one end side of the guide rails 12*a* and 12*b*, and a driving force from the driving motor 13 is moved along a timing belt 15 looped around a pulley 14*a* coupled with the driving motor 13 and a pulley 14*b* provided on the other end side of the guide rails 12*a* and 12*b*.

Further, conveying roller pairs 16 and 17 are provided on both the end portion sides in a direction perpendicular to a conveying direction of the carriage 11 and along the respective guide rails 12*a* and 12*b*. The conveying roller pairs 16 and 17 convey a recording medium S on the lower side of the carriage 11 and in the direction perpendicular to the conveying direction of the carriage 11.

Then, while the recording medium S is conveyed by the conveying roller pairs 16 and 17, scanning with the carriage 11 is performed in a direction perpendicular to a feeding direction of the recording medium S. Therefore, characters, images, and the like are recorded onto the recording medium S by the ink jet heads 20.

Note that the ink jet heads 20 are each of a large type for discharging monochromatic ink, and, for example, the four ink jet heads are mounted in parallel to the carriage 11 in correspondence with ink in four colors of black (B), yellow (Y), magenta (M), and cyan (C) in this embodiment.

Further, each ink tank 90 filled with ink of each color is provided at the position where the movement of the carriage 11 in the main scanning direction and the movement of the recording medium S are not interrupted and the position lower by a predetermined amount than a nozzle opening of the ink jet head 20 so as to impart a negative pressure to the inside of the ink jet head 20.

Moreover, the ink jet recording apparatus 10 is provided with an unillustrated external circuit for sending printing data and the like to a driving circuit of each of the ink jet heads 20, which will be described below in detail.

Note that, in the above-described ink jet recording apparatus 10, a so-called cleaning operation for wiping a surface of a nozzle plate of the ink jet head 20 to remove adhered ink is performed at predetermined timing, for example, timing of starting or timing before a printing start, or arbitrary timing.

Figure 2:
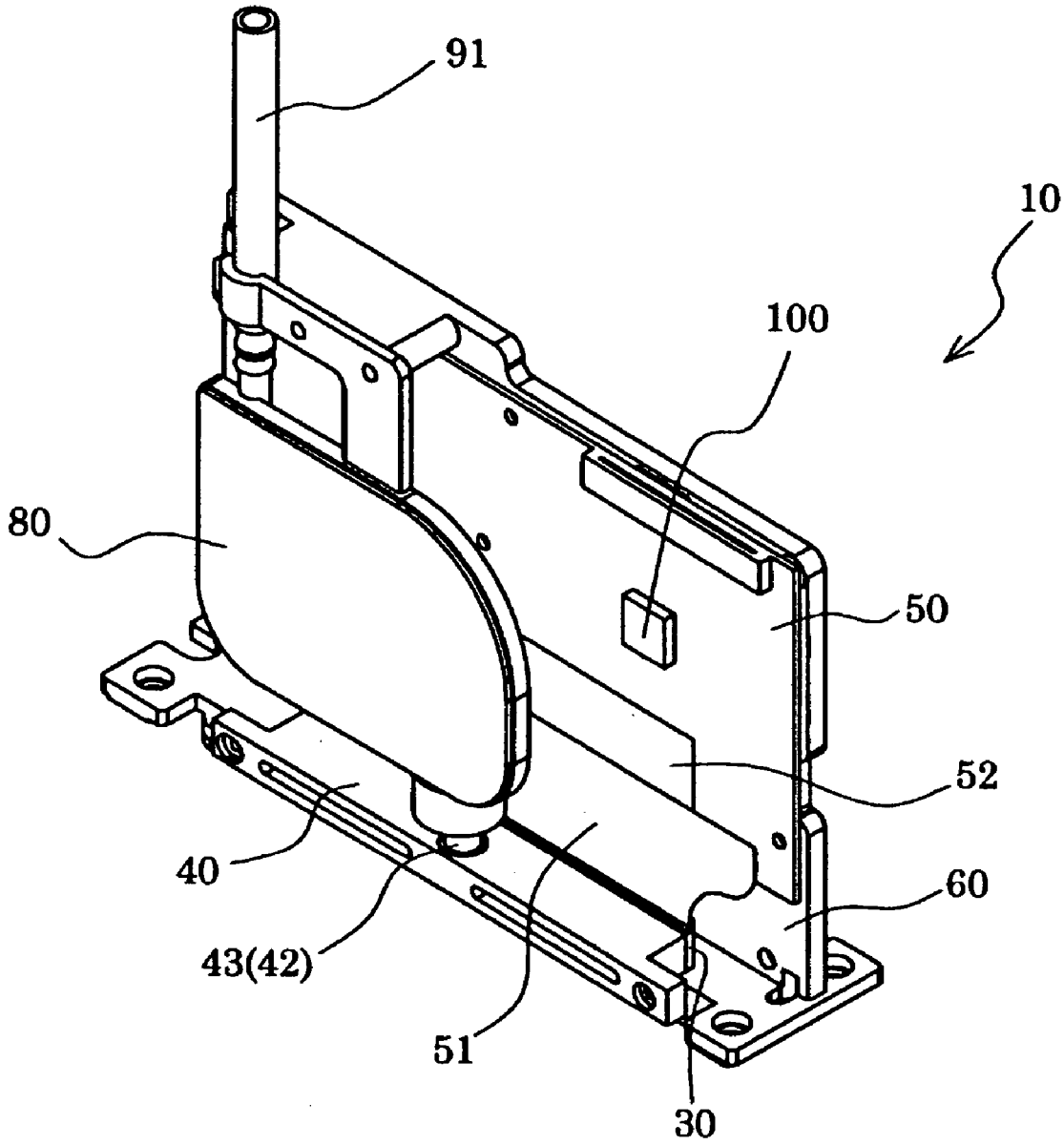
FIG. 2 is a perspective view of an ink jet head in accordance with Embodiment 1 of the present invention.
Figure 3:
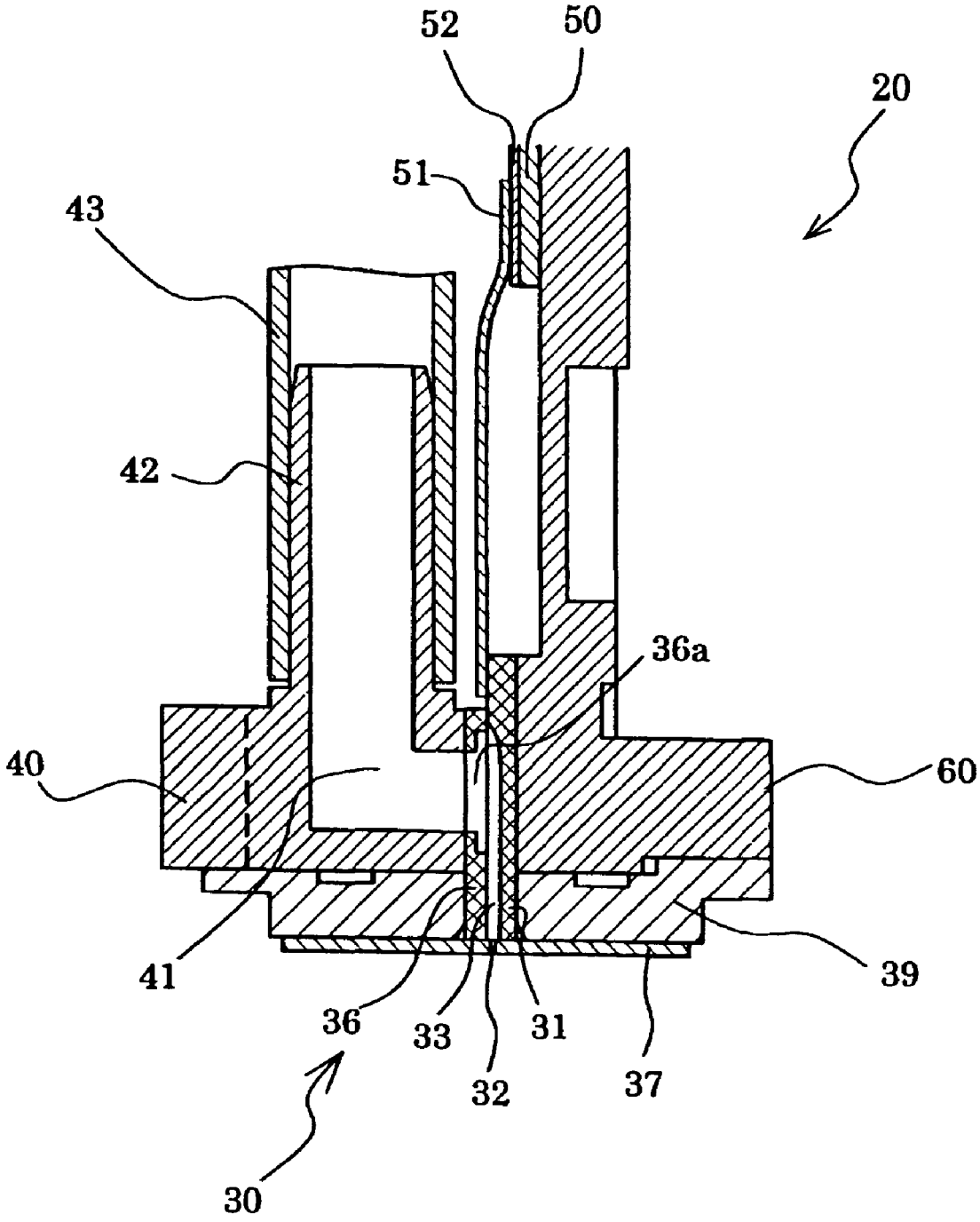
FIG. 3 is a sectional view of a main part of the ink jet head in accordance with Embodiment 1 of the present invention.
Figure 4A:
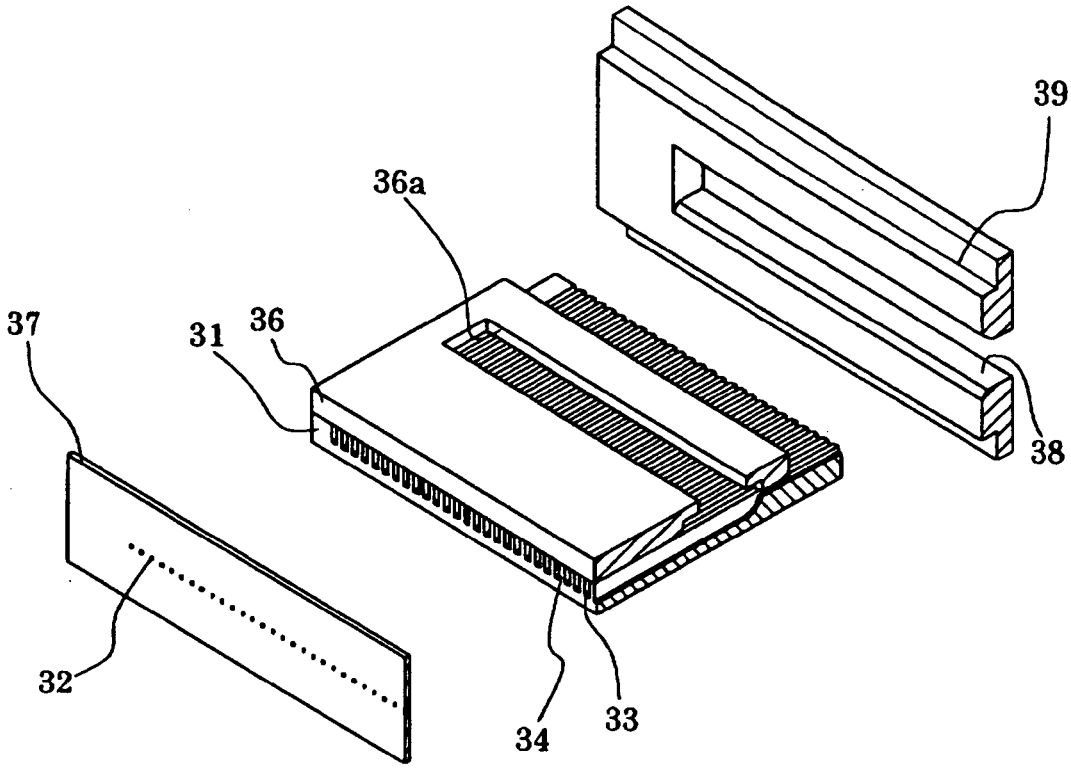
FIGS. 4A and 4B are an exploded perspective view and a perspective sectional view of a head chip of the ink jet head, respectively, in accordance with Embodiment 1 of the present invention.
Figure 4B:
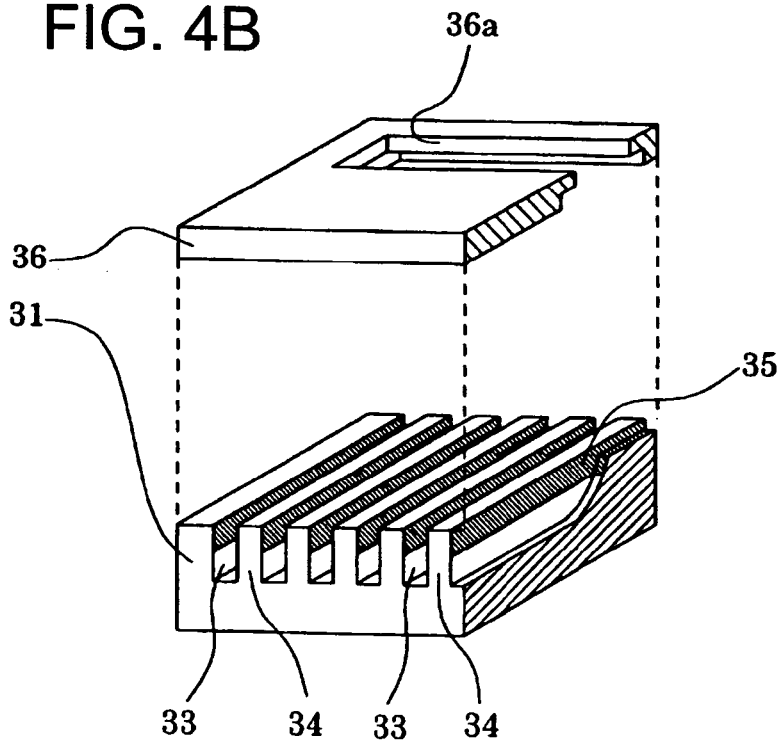

Here, description will be made of the ink jet head mounted to the above-described ink jet recording apparatus with reference to FIGS. 2, 3, and 4A and 4B. Note that FIG. 2 is a perspective view of the ink jet head in accordance with this embodiment; FIG. 3 is a sectional view of a main part of the ink jet head; and FIGS. 4A and 4B are an exploded perspective view and a perspective sectional view of a head chip.

As shown in the figures, the ink jet head 20 in this embodiment includes a head chip 30, a channel substrate 40 provided on the side of one surface thereof, and a wiring substrate 50 mounted with a driving circuit and the like for driving the head chip 30. The respective members are fixed to a base plate 60.

In a piezoelectric ceramic plate 31 that constitutes the head chip 30, plural channels or grooves 33 communicated with nozzle openings 32 are arranged in parallel with each other and are separated from one another by side walls 34. One end portion of each groove 33 in a longitudinal direction thereof is provided so as to extend to one end surface of the piezoelectric ceramic plate 31 while the other end portion is not extended toward the other end surface and gradually becomes shallow. Further, electrodes 35 for application of a driving electric field are formed on surfaces on the opening side of the side walls 34 on both sides in a width direction of each groove 33 along a longitudinal direction thereof.

Each groove 33 formed in the piezoelectric ceramic plate 31 is formed by, for example, a disk-shaped dice cutter, and a shape of a portion whose depth gradually becomes shallow is determined by a shape of the dice cutter. Further, the electrodes formed in each groove 33 are formed by performing, for example, known evaporation in an oblique direction.

One end of a flexible printed circuit (FPC) 51 is connected to the electrodes 35 provided on the opening side of both the side walls 34 of the above-described groove 33, and the other end of the FPC 51 is connected to a driving circuit 52 on the wiring substrate 50. Thus, the electrodes 35 are electrically connected to the driving circuit 52. In addition, a data storage means 100 described below is provided on the wiring substrate 50 in this embodiment.

Further, an ink chamber plate 36 is jointed to the opening side of the grooves 33 of the piezoelectric ceramic plate 31. The ink chamber plate 36 is provided with a common ink chamber 36*a* which is formed so as to penetrate the ink chamber plate 36 and which is provided over all the grooves 33 arranged in parallel with each other.

Note that the ink chamber plate 36 can be formed of a ceramic plate, a metal plate, or the like, but preferably is formed of the ceramic plate whose coefficient of thermal expansion is approximate to that of the piezoelectric ceramic plate 31 in consideration of deformation caused after the ink chamber plate 36 is jointed with the piezoelectric ceramic plate 31.

Further, a nozzle plate 37 is jointed to an end surface, which is opened with the grooves 33, of a joint member of the piezoelectric ceramic plate 31 and the ink chamber plate 36. Nozzle openings 32 are formed at positions, which are opposite to the respective grooves 33, in the nozzle plate 37.

In this embodiment, the nozzle plate 37 is larger in area than the end surface, which is opened with the grooves 33, of the joint member of the piezoelectric ceramic plate 31 and the ink chamber plate 36. The nozzle plate 37 is obtained by forming the nozzle openings 32 in a polyimide film or the like with the use of, for example, an excimer laser apparatus. Further, although not shown in the figure, a repellent film with repellency for avoiding ink adhesion and the like is provided on a surface, which is opposite to a printed material, of the nozzle plate 37.

Further, a nozzle supporting plate 39 provided with an engagement hole 38 to be engaged with the joint member is jointed to an outer circumferential surface on the side of the end surface, which is opened with the grooves 33, of the joint member of the piezoelectric ceramic plate 31 and the ink chamber plate 36. Note that the nozzle supporting plate 39 is jointed to the outside of the end surface, which is jointed to the joint member, of the nozzle plate 37 so as to stably hold the nozzle plate 37.

A surface, which is opposite to the ink chamber plate 36, of the piezoelectric ceramic plate 31 in the head chip 30 with the above-described structure is jointed and fixed to the base plate 60. On the other hand, the channel substrate 40 is jointed to one surface of the ink chamber plate 36.

Note that provided on a surface of the channel substrate 40 is a coupling portion 42 which is provided projectedly along the base plate 60 and which is opened with an ink supply path 41. The coupling portion 42 is connected with one end portion of an ink communicating pipe 43 formed of a stainless-steel pipe or the like. Further, the other end of the ink communicating pipe 43 is connected to an ink reservoir portion 80, which is connected to an ink tank such as an ink cartridge through the ink supply pipe 91, for temporarily reservoiring a predetermined amount of ink (refer to FIG. 1).

Here, description will be made of the above-described ink jet recording apparatus 10, particularly the external circuit and the data storage means, with reference to FIG. 5. Note that FIG. 5 is a control block diagram showing a control system of the ink jet recording apparatus.

Figure 5:
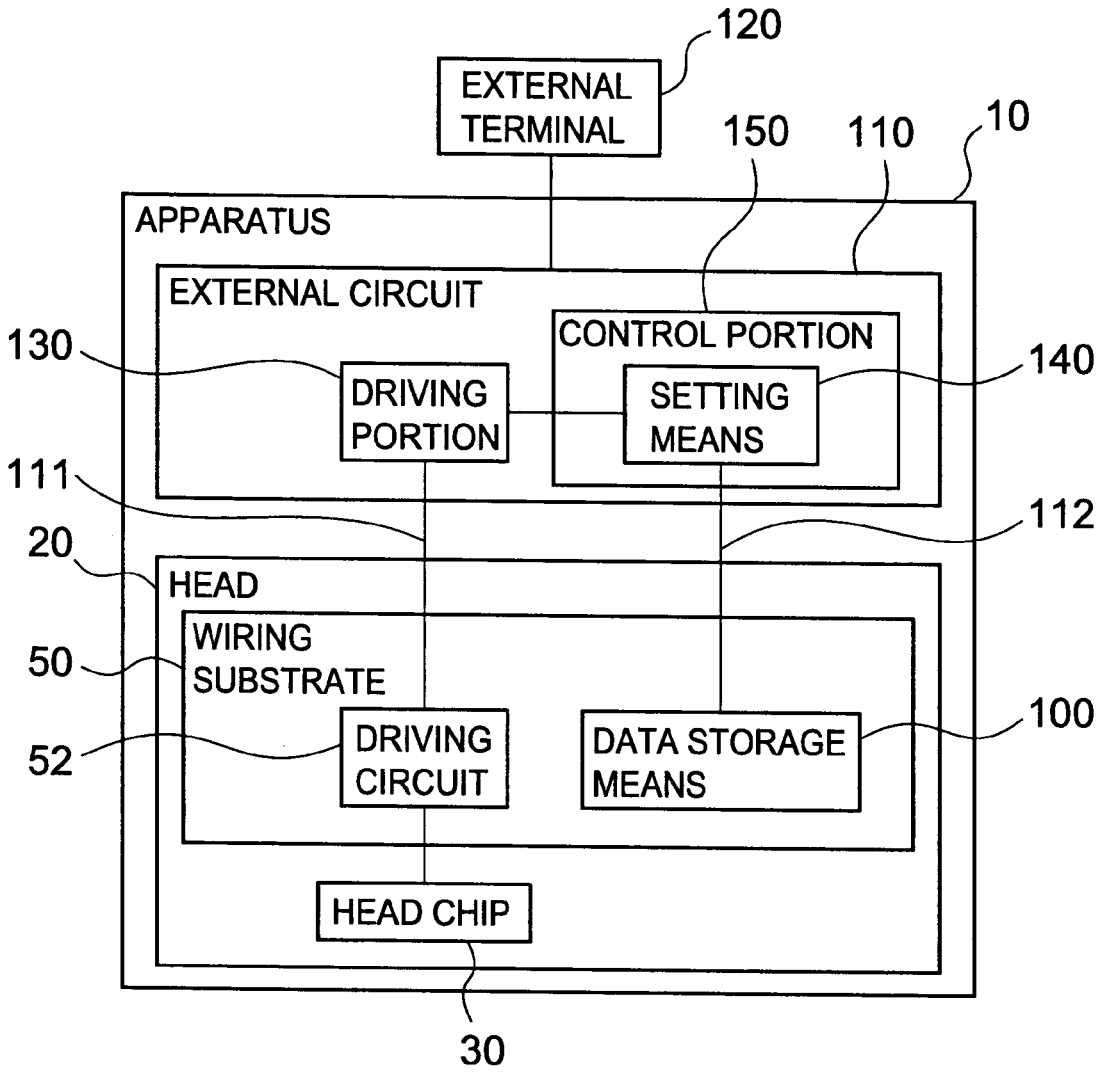
FIG. 5 is a control block diagram for explaining a control system of the ink jet recording apparatus in accordance with Embodiment 1 of the present invention.

As shown in FIG. 5, the ink jet recording apparatus 10 in this embodiment is provided with the ink jet head 20 and an external circuit 110 connected to the ink jet head 20. The external circuit 110 is connected to an external terminal 120 such as a personal computer (PC).

Further, the ink jet head 20 is provided with the head chip 30 and the wiring substrate 50 as described above. In this embodiment, a driving circuit 52 connected to the head chip 30 and the data storage means 100 in which a plurality of types of driving information data of the ink jet head 20 are stored are provided on the wiring substrate 50.

On the other hand, in this embodiment, the external circuit 110 is constituted by: a driving portion 130 connected to the driving circuit 52 through a signal line 111; and a control portion 150 which includes a setting means 140 and which is connected to the data storage means 100 through a control line 112.

The driving portion 130 has a function of sending printing data and the like from the external terminal 120 to the ink jet head 20. That is, when the printing data and the like are input to the driving circuit 52 through the signal line 111, a predetermined driving voltage is applied to the electrodes 35 of each groove 33 of the head chip 30 from the driving circuit 52. Then, in the ink jet head 20 in which application of the driving voltage is performed, the volume in each groove 33 is varied to discharge the ink filled therein from the nozzle opening 32.

Further, the control portion 150 is comprised of, for example, a CPU, and has the setting means 140 connected to the data storage means 100 provided therein. The setting means 140 has a function of reading the driving information data stored in the data storage means 100 and automatically setting driving conditions of the ink jet head 20.

For example, in this embodiment, it is set that the setting means 140 reads the magnitude of the driving voltage applied to the electrodes 35 of each groove 33 of the head chip 30, that is, driving condition data that is voltage rank data, and automatically sets the voltage rank of the ink jet head 20.

Specifically, after reading the voltage rank data stored in the data storage means 100, the setting means 140 sends the voltage rank data to the driving portion 130 to automatically set the voltage rank of the ink jet head 20 in the driving portion 130. That is, the voltage rank corresponding to each of the ink jet heads 20 for four colors is automatically set in the driving portion 130 through the setting means 140. Then, when the printing data and the like are input from the external terminal 120 to the driving portion 130, a corresponding driving voltage with a predetermined magnitude is applied to each ink jet head 20 through the driving circuit 52.

Note that, as examples of the above-described data storage means 100, non-volatile memories, such as electrically erasable and programmable read only memory (EEPROM) and flash ROM, and RAM can be given. In this embodiment, the EEPROM is used.

Figure 6:
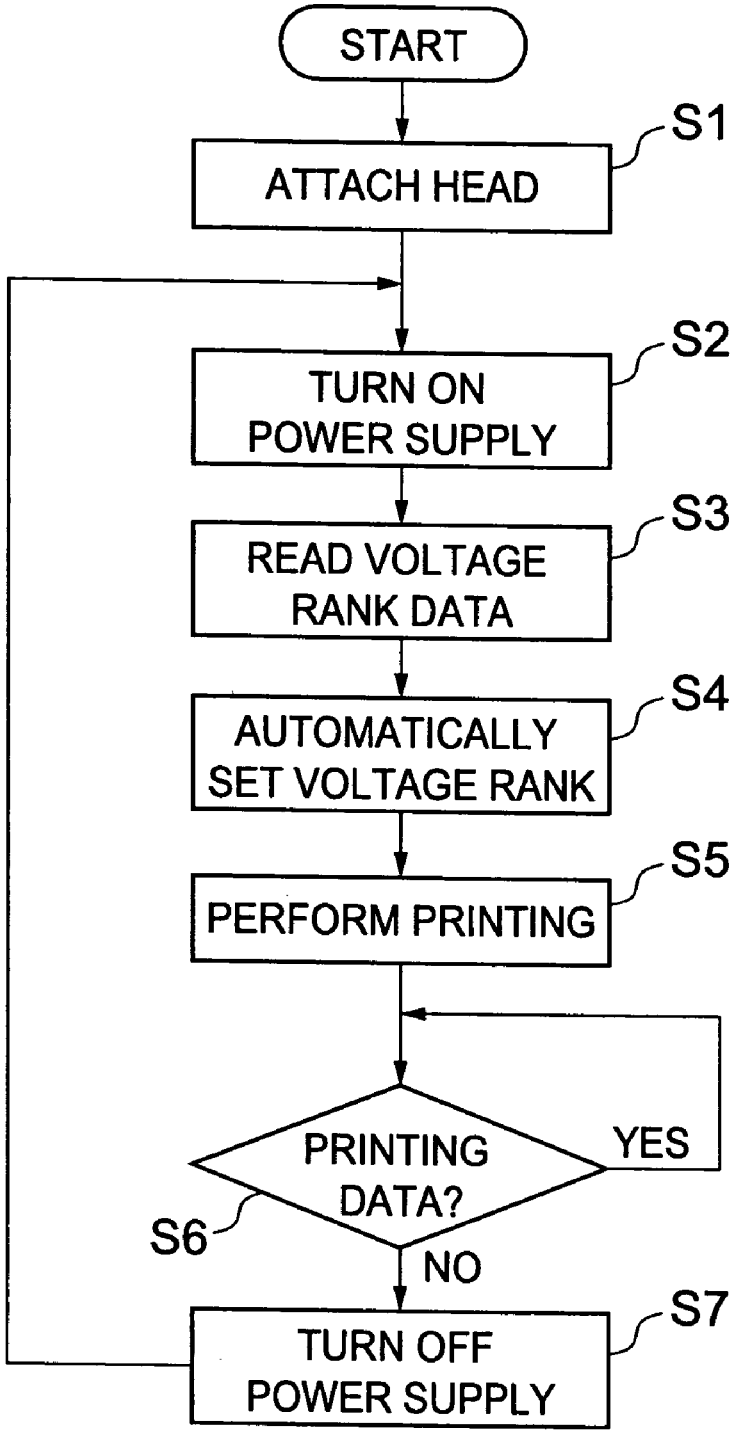
FIG. 6 is a chart showing a procedure of automatically setting a voltage rank of the ink jet head in accordance with Embodiment 1 of the present invention.

Here, description is made of a procedure in which the setting means 140 automatically sets the voltage rank of the ink jet head 20 with reference to FIG. 6. Note that FIG. 6 is a chart showing the procedure of automatically setting the voltage rank of the ink jet head.

As shown in FIG. 6, first, the ink jet head 20 is attached to the ink jet recording apparatus 10 (step S1). For example, in this embodiment, the ink jet heads for respective colors of black (B), yellow (Y), magenta (M), and cyan (C) are attached to the above-described carriage 11. Next, an unillustrated power supply of the ink jet recording apparatus 10 is turned on (step S2). Thus, the setting means 140 reads the voltage rank data stored in the data storage means 100 (step S3), and automatically sets the voltage rank corresponding to each of the ink jet heads 20 (step S4). Note that printing is then performed in accordance with the printing data from the external circuit 110 (step S5). Thereafter, in the case where the printing data exists at step S6 (YES), printing is continuously performed. In the case where the printing data does not exist at step S6 (NO), the power source is turned off for the completion of printing (step S7).

As described above, in the ink jet recording apparatus 10 in this embodiment, the ink jet head 20 is provided with the data storage means 100 for storing the voltage rank data, and the external circuit 110 is provided with the setting means 140 for reading the voltage rank data stored in the data storage means 100 and automatically setting the voltage rank of the ink jet head 20. Therefore, the operation for managing and setting the voltage rank can be simplified. For example, the setting operation of the voltage rank through manual input is not required in each case of shipment, exchange, or the like of the ink jet head 20. Thus, the setting operation of the voltage rank can be simplified. Further, since the management and setting of the voltage rank are automatically performed, for example, error input and the like are not caused due to a manual operation. Therefore, an effect of reliable prevention of setting errors is also provided.

Further, as in this embodiment, in the ink jet recording apparatus 10 in which the carriage 11 is mounted with the four ink jet heads 20 arranged in parallel and corresponding to ink in four colors, the voltage ranks of the respective ink jet heads 20 are individually and automatically set. Therefore, the operation for setting the voltage rank can be considerably simplified.

Embodiment 2

Figure 7:
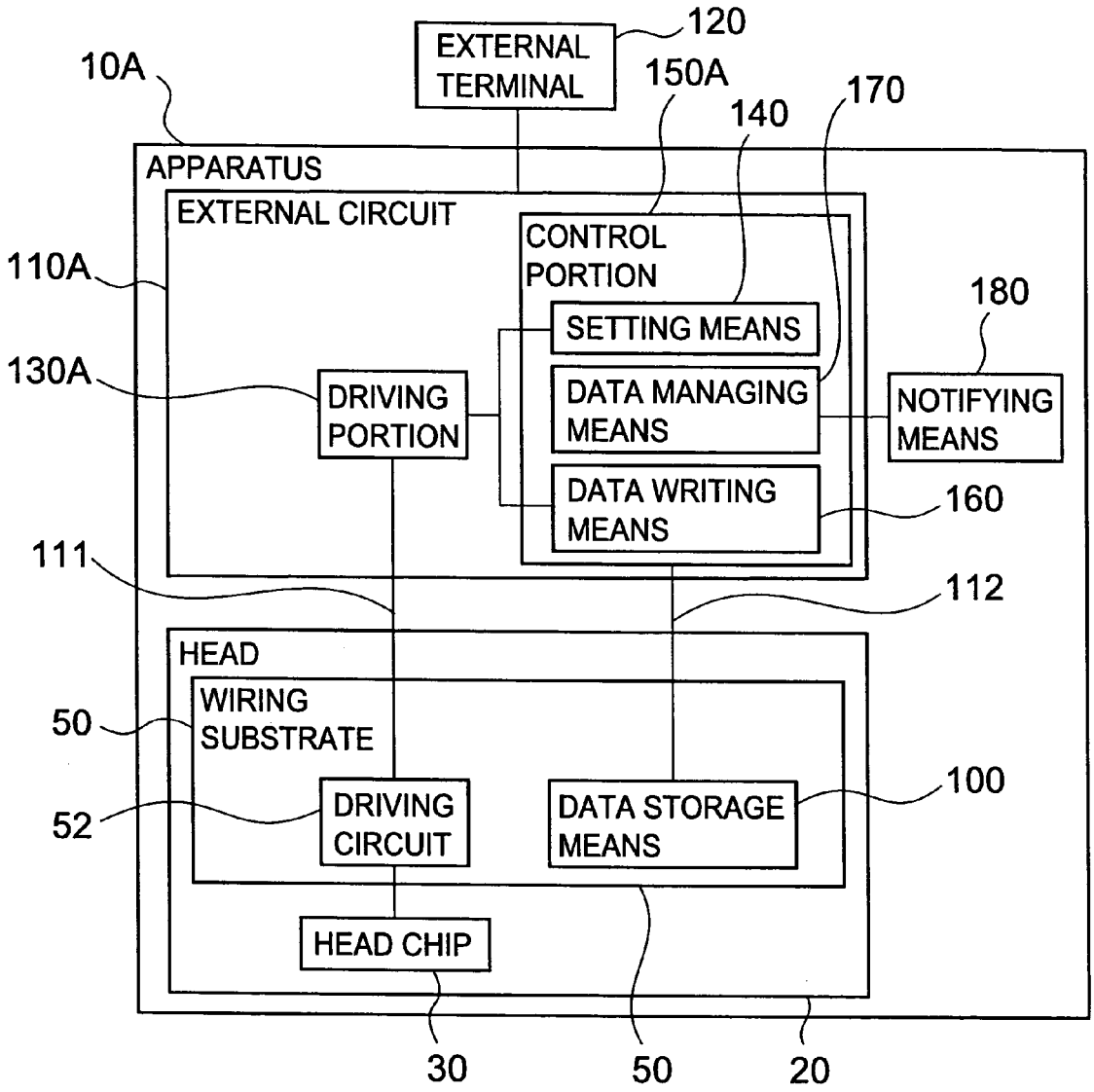
FIG. 7 is a control block diagram for explaining a control system of an ink jet recording apparatus in accordance with Embodiment 2 of the present invention.

FIG. 7 is a control block diagram for explaining a control system of an ink jet recording apparatus in accordance with Embodiment 2 of the present invention. Note that the same parts as those in Embodiment 1 described above are denoted by the same reference numerals, and overlapping description is omitted here.

As shown in FIG. 7, an ink jet recording apparatus 10A in this embodiment has the same basic structure as the ink jet recording apparatus 10 in Embodiment 1 except the point in that: a data writing means 160 and a data managing means 170 are provided in a control portion 150A in an external circuit 110A; and further, a notifying means 180 connected to the data managing means 170 is provided.

The data writing means 160 is connected to a driving portion 130A and to the data storage means 100. The data writing means 160 has a function of acquiring the number of times of ink discharge of the ink jet head 20 from the driving portion 130A and storing the acquired number of times of ink discharge as dot count data in the data storage means 100. For example, in the case where the dot count data has not been stored in the data storage means 100, the dot count data is stored in the data storage means 100 as it is. Further, in the case where the dot count data which is used before is stored in the data storage means 100, the additional number of times of ink discharge is added to the dot count data.

Note that the timing at which the dot count data is stored in the data storage means 100 by the data writing means 160 is preferably at, for example, the time of a cleaning operation, the time after printing of one sheet, or the time of turning-on or turning-off of a power supply.

On the other hand, the data managing means 170 has a function of managing the dot count data in the data storage means 100. That is, the data managing means 170 makes the notifying means 180 operate at the time point when the dot count data attains a predetermined value or more in this embodiment. Examples of the notifying means 180 may include a blink of a warning lamp and an alarm. Further, the drive of the ink jet head 20 may be stopped depending on the circumstances.

Thus, the exchange timing of the ink jet head 20 can be reliably notified to a user. Note that the time point when the dot count data attains a predetermined value or more indicates the lifetime of the ink jet head 20 in this embodiment.

Here, description will be made of the notifying means 180 for notifying the exchange timing of the ink jet head 20 with reference to FIG. 8. Note that FIG. 8 is a chart showing a procedure of notifying the exchange timing of the ink jet head.

Figure 8:
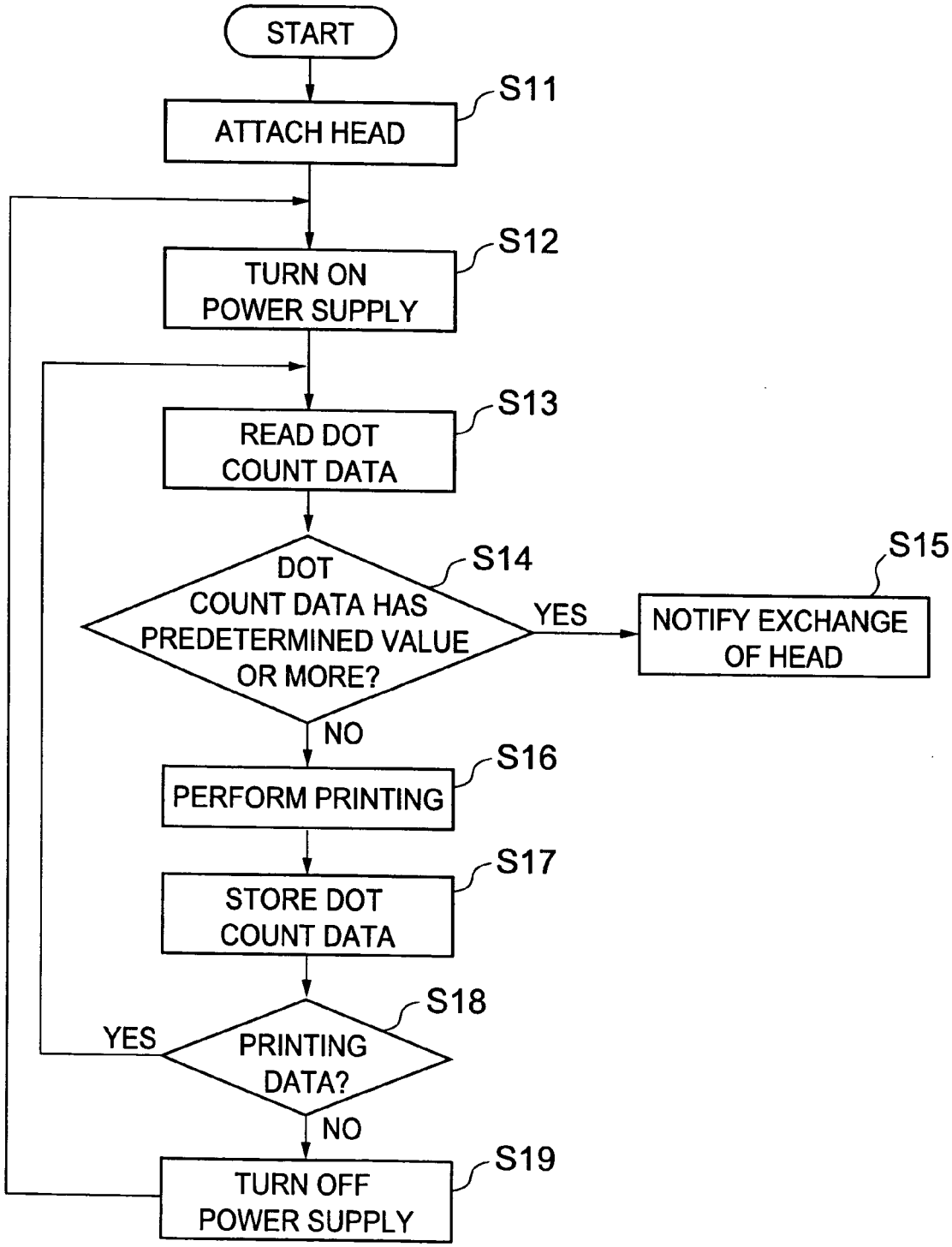
FIG. 8 is a chart showing a procedure of announcing exchanging timing of an ink jet head in accordance with Embodiment 2 of the present invention.
Figure 9:
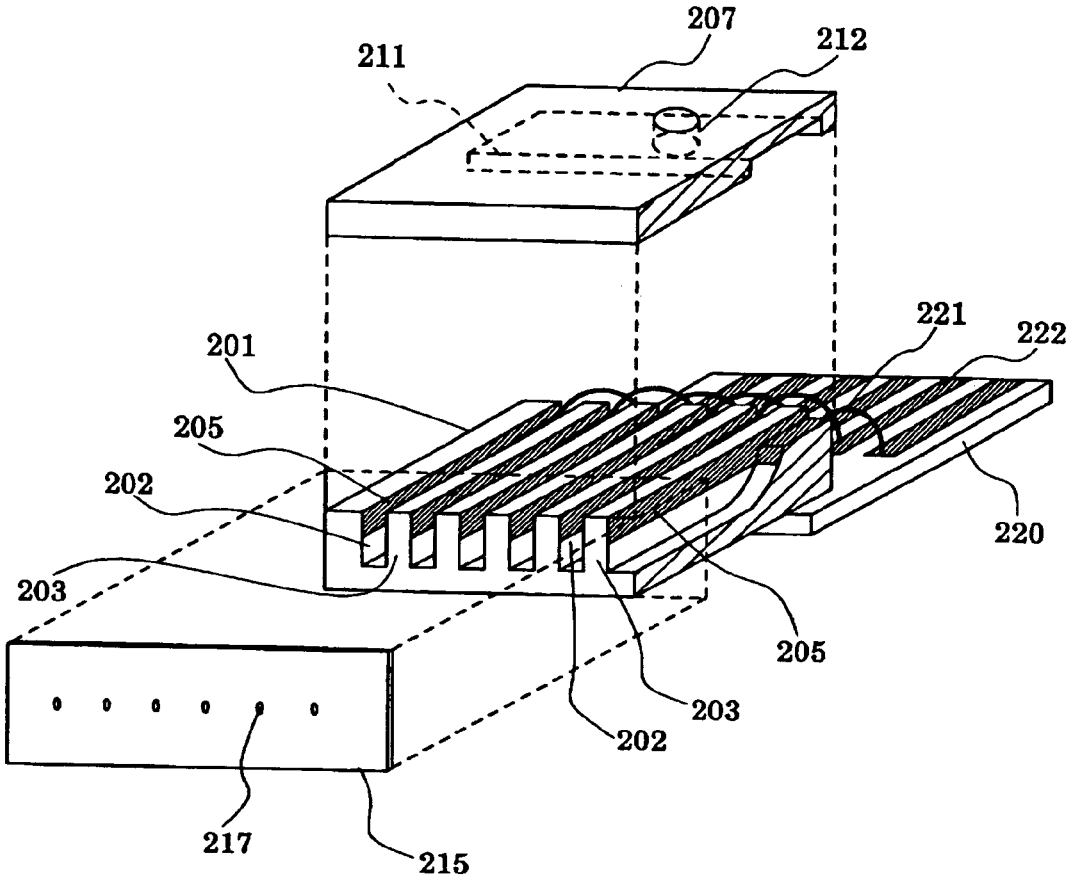
FIG. 9 PRIOR ART
FIG. 9 is an exploded perspective view showing an outline of an ink jet head according to the prior art.
Figure 10A:
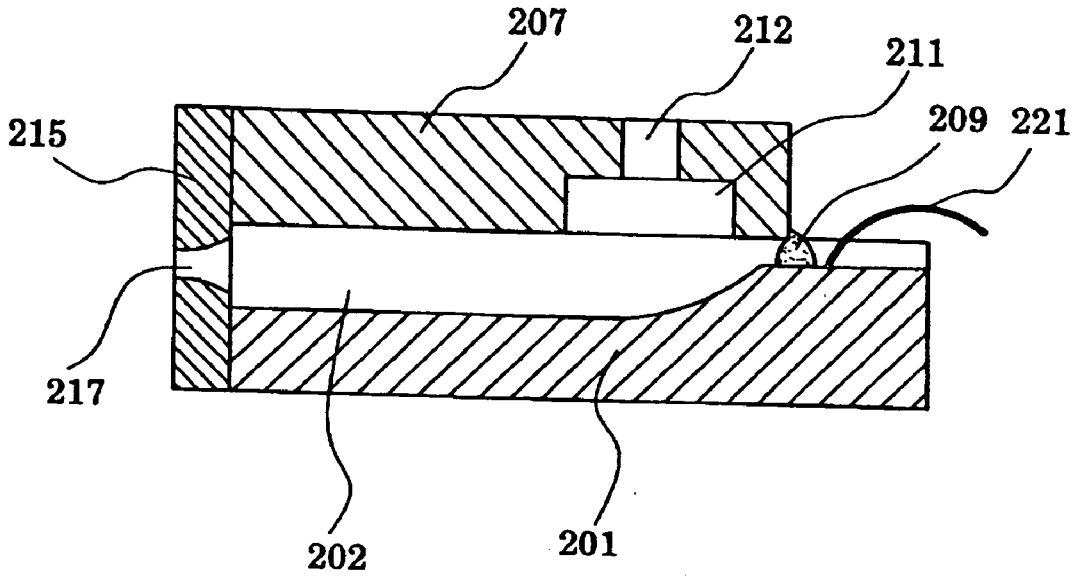
FIG. 10A PRIOR ART
FIGS. 10A and 10B are sectional views showing the outline of the ink jet head according to the prior art.
Figure 10B:
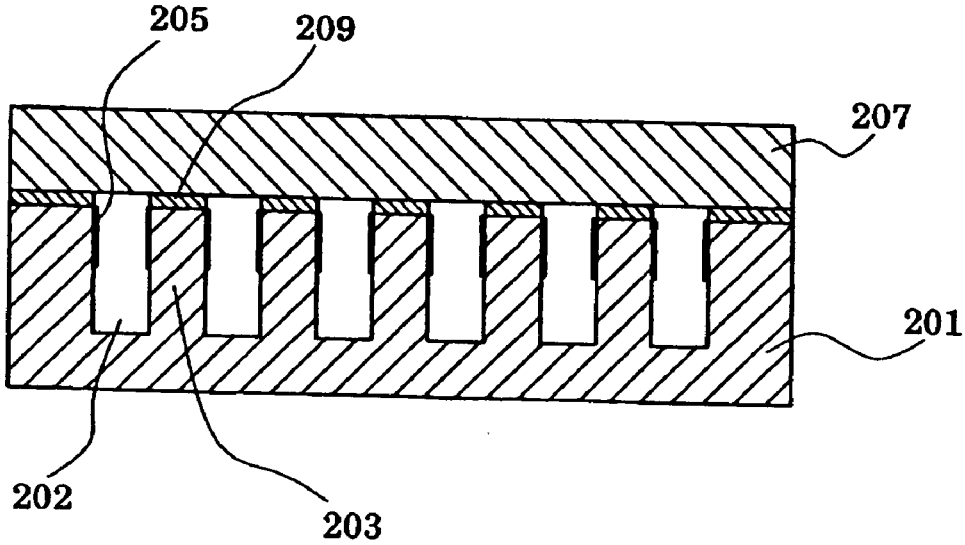
FIG. 10B PRIOR ART
Figure 11:
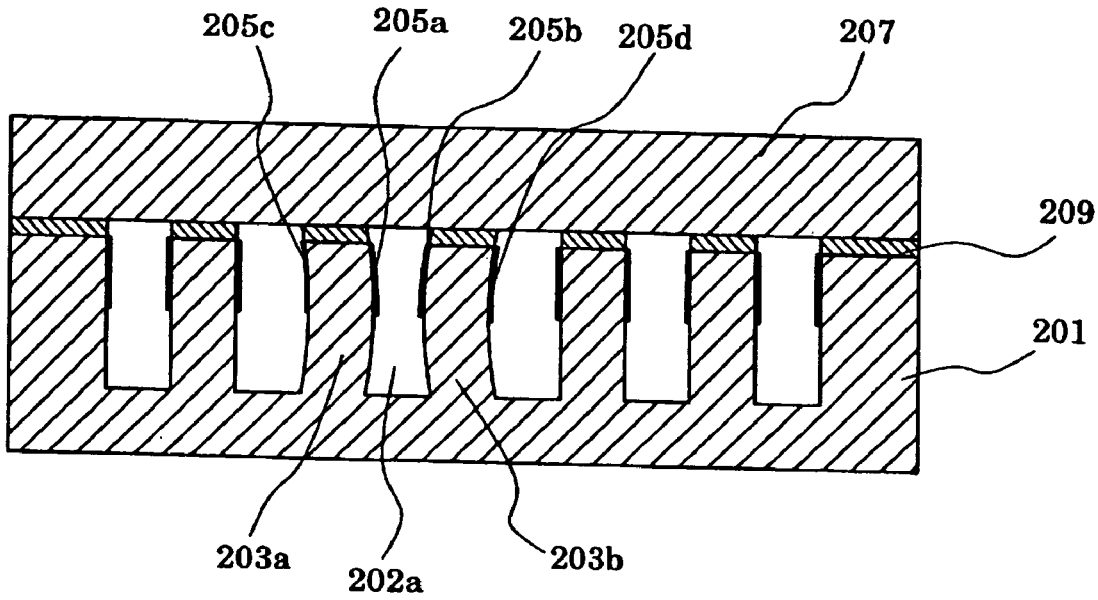
FIG. 11 PRIOR ART
FIG. 11 is a sectional view showing the outline of the ink jet head according to the prior art.

In this embodiment, as shown in FIG. 8, first, the ink jet head 20 is attached to the carriage 11 in the ink jet recording apparatus 10 (step S11). Next, the unillustrated power supply of the ink jet recording apparatus 10 is turned on (step S12). Thus, the data managing means 170 reads the dot count data stored in the data storage means 100 (step S13). Then, in the case where the dot count data read by the data managing means 170 has a predetermined value or more (YES) at step S14, the notifying means 180 is made to operate to notify to the user that the ink jet head 20 needs to be exchanged (step S15). On the other hand, in the case where the dot count data has a smaller value than the predetermined value (NO) at step S14, the driving portion 130 sends the printing data from the external circuit 110 to the driving circuit 52, and printing is performed in accordance with the printing data (step S16). Then, the dot count data corresponding to printing at step S16 is stored in the data storage means 100 by the data writing means 160 at the time of the cleaning operation or the like (step S17). Subsequently, in the case where the printing data exists (YES) at step S18, the step returns to step S13 again, and then, the operation of steps S14 to S17 described above is performed. On the other hand, in the case where the printing data does not exist (NO) at step S18, the power supply is turned off for the completion of printing (step S19).

As described above, the dot count data of the ink jet head 20 is stored in the data storage means 100 in this embodiment. Thus, the usage status of the ink jet head 20 can be grasped with relative ease. Note that the description of the setting means 140 for automatically setting the voltage rank is omitted in this embodiment, but, needless to say, the action effect of the setting means 140 is the same as that in Embodiment 1.

Further, in this embodiment, the dot count data of each ink jet head 20 is automatically managed. Thus, this is effective for the case where the plural ink jet heads 20 are mounted to the ink jet recording apparatus 10A, the case where the plural ink jet heads 20 are frequently replaced with one another, and other cases.

Further, when the usage status of the ink jet head 20, that is, the dot count data can be grasped by the user, in the case where performance of the ink jet head 20, for example, an ink discharge characteristic is deteriorated, the information on the usage status or dot count data serves as a judgment factor on whether the cause of the deterioration is the lifetime of the ink jet head 20. On the other hand, a manufacturer can acquire the dot count data of the ink jet head 20 which is acquired by the user, and thus, the dot count data serves as a judgment factor for discovering the cause of the failure of the ink jet head 20. Therefore, there is also obtained an effect that the cause of the failure of the ink jet head 20 can be promptly discovered in this embodiment.

Other Embodiment

Hereinabove, the description has been made of the respective embodiments according to the present invention. However, the basic structure of an ink jet recording apparatus is not limited to those described above.

In Embodiments 1 and 2 described above, as the driving information data of the ink jet head 20, the voltage rank data or dot count data is stored in the data storage means 100. However, the present invention is not limited to this. For example, driving information data such as an ID of each ink jet head 20, a type of ink to be used, the number of nozzle openings, and resolution may be stored in the data storage means 100. Note that it is sufficient that the above driving information data is automatically set by the external circuit 110 or 110A after, for example, the ink jet head 20 is mounted to the ink jet recording apparatus 10 or 10A and the power supply is turned on.

Further, when the number of times of exchange or the like of the ink jet head 20 is stored in the data storage means 100, the information serves as a judgment factor for projecting the cause of the failure of the ink jet head 20.

Moreover, the dot count data may be counted in one-nozzle units or block units, for example, four-nozzle units, and the counted data may be stored in the data storage means 100. The dot count data corresponding to a predetermined nozzle unit serves as a more detailed judgment factor for discovering the cause of the failure of the ink jet head 20.

Furthermore, the ink jet head of large type in which monochromatic printing is performed with one head is exemplified in Embodiments 1 and 2. However, the present invention is not limited to this. An ink jet head may be adopted which is of small type in which printing in plural colors can be performed with one head.

Note that the description has been made of, as an example, the ink jet recording apparatus 10 mounted with the four ink jet heads 20 in Embodiments 1 and 2. However, an ink jet recording apparatus may be adopted in which ink jet heads 20 are mounted for respective colors in correspondence with ink in five colors or more, for example, five to eight colors. Thus, when the present invention is applied to an ink jet recording apparatus mounted with five or more ink jet heads 20, the operation for setting the driving conditions of the ink jet head 20 can be considerably simplified, and the dot count data for each ink jet head 20 can be easily managed.

As described above, in the ink jet recording apparatus according to the present invention, the ink jet head is provided with the data storage means for storing the driving information data at least including the driving condition data of the ink jet head, and the external circuit is provided with the setting means, which is connected to the data storage means, for reading at least the driving condition data stored in the data storage means and automatically setting the driving conditions of the ink jet head. Therefore, the operation for managing and setting the driving conditions of the ink jet head can be simplified, and the usage status of the ink jet head can be reliably grasped.

What is claimed is:

1. An ink jet recording apparatus comprising:

an ink jet head comprised of a piezoelectric ceramic plate having at least a pair of partition walls with deformable side walls spaced apart at a preselected distance to form a channel for receiving ink and communicating with a nozzle opening, a pair of electrodes each connected to respective ones of the side walls of the partition walls, a wiring substrate mounted with a driving circuit including a driving integrated circuit for applying a driving voltage to the pair of electrodes to deform the side walls of the partition walls of the piezoelectric ceramic plate to vary the volume of the channel to thereby eject ink from the nozzle opening, and data storage means for storing two or more different types of driving information data of the ink jet head including driving condition data; and an external circuit connected to the driving circuit of the ink jet head and having setting means for reading at least the driving condition data stored in the data storage means and automatically setting driving conditions of the ink jet head in accordance with the driving condition data.

2. An ink jet recording apparatus according to claim 1; wherein the driving condition data of the ink jet head includes voltage rank data for setting a magnitude of the driving voltage applied by the driving integrated circuit to a predetermined value.

3. An ink jet recording apparatus according to claim 1; wherein the driving information data includes dot count data obtained by counting the number of times of ink discharge of the ink jet head.

4. An ink jet recording apparatus according to claim 3; further comprising data writing means for storing the number of times of ink discharge of the ink jet head as the dot count data in the data storage means.

5. An ink jet recording apparatus according to claim 4; further comprising data managing means for managing the dot count data stored in the data storage means; and notifying means for notifying that the ink jet head is close to the end of its lifetime, the data managing means controlling the notifying means to operate at a time point when the dot count data attains a predetermined value or higher.

6. An ink jet recording apparatus comprising: an ink jet head comprised of a substrate having an ink chamber for storing ink and at least a pair of partition walls with deformable side walls spaced apart at a preselected distance to form a channel for receiving ink from the ink chamber, a pair of electrodes each connected to respective ones of the side walls of the partition walls, a driving circuit for applying a driving voltage to the pair of electrodes to deform the side walls of the partition walls of the piezoelectric ceramic plate to vary the volume of the channel to thereby eject ink from the channel, and data storage means for storing a plurality of different types of driving information data including driving condition data of the ink jet head; and an external circuit connected to the driving circuit of the ink jet head and having setting means for reading at least the driving condition data stored in the data storage means and automatically setting driving conditions of the ink jet head in accordance with the driving condition data.

7. An ink jet recording apparatus according to claim 6; wherein the driving information data further includes dot count data obtained by counting the number of times of ink discharge of the ink jet head.

8. An ink jet recording apparatus according to claim 7; further comprising data writing means for storing the number of times of ink discharge of the ink jet head as the dot count data in the data storage means.

9. An ink jet recording apparatus according to claim 8; further comprising data managing means for managing the dot count data stored in the data storage means; and notifying means for notifying that the ink jet head is close to the end of its lifetime, the data managing means controlling the notifying means to operate at a time point when the dot count data attains a predetermined value or higher.

10. An ink jet recording apparatus according to claim 9; wherein the driving information data further includes dot count data obtained by counting the number of times of ink discharge of the ink jet head.

11. An ink jet recording apparatus according to claim 10; wherein the driving condition data of the ink jet head includes voltage rank data for setting a magnitude of the driving voltage applied by the driving circuit to a predetermined value.

12. An ink jet recording apparatus according to claim 6; wherein the driving condition data of the ink jet head includes voltage rank data for setting a magnitude of the driving voltage applied by the driving circuit to a predetermined value.

13. An ink jet recording apparatus comprising: an ink jet head comprised of a substrate having an ink chamber for storing ink and a plurality of partition walls having deformable side walls spaced apart at a preselected distance to form a plurality of channels for receiving ink from the ink chamber, a plurality of electrodes each connected to respective ones of the side walls, a driving circuit for applying a driving voltage to the electrodes to deform the side walls to vary the volume of the channels to thereby eject ink from the channels, and data storage means for storing a plurality of different types of driving information data including driving condition data of the ink jet head; and an external circuit connected to the driving circuit of the ink jet head and having setting means for reading at least the driving condition data stored in the data storage means and automatically setting driving conditions of the ink jet head in accordance with the driving condition data.

14. An ink jet recording apparatus according to claim 13; wherein the driving information data further includes dot count data obtained by counting the number of times of ink discharge of the ink jet head.

15. An ink jet recording apparatus according to claim 14; further comprising data writing means for storing the number of times of ink discharge of the ink jet head as the dot count data in the data storage means.

16. An ink jet recording apparatus according to claim 15; further comprising data managing means for managing the dot count data stored in the data storage means;

and notifying means for notifying that the ink jet head is close to the end of its lifetime, the data managing means controlling the notifying means to operate at a time point when the dot count data attains a predetermined value or higher.

17. An ink jet recording apparatus according to claim 16; wherein the driving information data further includes dot count data obtained by counting the number of times of ink discharge of the ink jet head.

18. An ink jet recording apparatus according to claim 17; wherein the driving condition data of the ink jet head includes voltage rank data for setting a magnitude of the driving voltage applied by the driving circuit to a predetermined value.

19. An ink jet recording apparatus according to claim 13; wherein the driving condition data of the ink jet head includes voltage rank data for setting a magnitude of the driving voltage applied by the driving circuit to a predetermined value.

20. An ink jet recording apparatus according to claim 13; further comprising a nozzle plate connected to the substrate and having a plurality of nozzle openings each disposed in communication with respective ones of the channels so that when the electrodes are driven by a voltage signal ink is ejected from the channels through the nozzle openings.

* * * * *